US008689690B2

(12) United States Patent
Pisella et al.

(10) Patent No.: US 8,689,690 B2
(45) Date of Patent: Apr. 8, 2014

(54) SAFETY AND ARMING DEVICE WITH BREAKABLE LOCK

(75) Inventors: Christian Pisella, Beaucroissant (FR); Christophe Kergueris, Grenoble (FR); Laurent Reynard, Bourges (FR); Renaud Lafont, Bourges (FR); Pierre-Marie Visse, Meylan (FR)

(73) Assignee: Nexter Munitions, Versailles (FR)

( * ) Notice: Subject to any disclaimer, the term of this patent is extended or adjusted under 35 U.S.C. 154(b) by 0 days.

(21) Appl. No.: 13/358,719

(22) Filed: Jan. 26, 2012

(65) Prior Publication Data

US 2012/0192746 A1 Aug. 2, 2012

(30) Foreign Application Priority Data

Jan. 31, 2011 (FR) ..... 11 00310

(51) Int. Cl.
*F42C 15/24* (2006.01)

(52) U.S. Cl.
USPC ..... 102/251; 102/222; 102/231; 102/235; 102/244; 102/247

(58) Field of Classification Search
USPC ..... 102/251, 247, 231, 233, 223, 221, 235, 102/202.7, 501, 226, 530, 254
See application file for complete search history.

(56) References Cited

U.S. PATENT DOCUMENTS

| | | | | |
|---|---|---|---|---|
| 6,173,650 | B1 | 1/2001 | Garvick et al. | |
| 6,622,629 | B2 | 9/2003 | Hodge et al. | |
| 6,964,231 | B1 * | 11/2005 | Robinson et al. | 102/235 |
| 7,320,286 | B2 * | 1/2008 | Karmazyn | 102/251 |
| 7,490,552 | B1 | 2/2009 | Jean et al. | |
| 7,552,681 | B1 | 6/2009 | Laib et al. | |
| 8,459,184 | B2 * | 6/2013 | Pisella et al. | 102/235 |
| 2009/0205526 | A1 * | 8/2009 | Lafont | 102/235 |

FOREIGN PATENT DOCUMENTS

| | | |
|---|---|---|
| EP | 1 559 986 A1 | 8/2005 |
| EP | 1 559 987 A1 | 8/2005 |
| EP | 2 077 431 A2 | 7/2009 |
| FR | 2 884 602 A1 | 10/2006 |

OTHER PUBLICATIONS

French Search Report issued in French Application No. 1100310 on Sep. 22, 2011 (with translation).

* cited by examiner

*Primary Examiner* — Michael Carone
*Assistant Examiner* — John D Cooper
(74) *Attorney, Agent, or Firm* — Oliff PLC.

(57) ABSTRACT

A micro-machined or micro-engraved safety and arming device for a projectile pyrotechnic train, said device comprising a substrate onto which a shutter is positioned to ensure the blocking of a channel, said shutter being mobile in translation on said substrate, said shutter being held immobile in the safety position by at least one acceleration lock that is released further to the application of the axial acceleration imparted to said projectile during firing, wherein said acceleration lock is constituted by at least one breakable tongue linking said shutter to said substrate, said tongue being oriented and dimensioned such that the axial inertial stresses developed during firing and exerted on said shutter cause said tongue to break.

12 Claims, 3 Drawing Sheets

SAFETY AND ARMING DEVICE WITH BREAKABLE LOCK

BACKGROUND OF THE INVENTION

1. Field of the Invention

The technical scope of the invention is that of safety and arming devices for a pyrotechnic train of a projectile and namely micro-machined safety and arming devices.

2. Description of the Related Art

Safety and arming devices (DSA) are well known. They generally incorporate a screen blocking the transmission channel which connects a detonator and pyrotechnic charge.

The screen is thus positioned across the transmission channel of the detonic wave between the detonator and charge and it prevents the latter from functioning.

One of the problems encountered with classical devices is their volume. The parts are relatively massive so as to be able to ensure the interruption of the pyrotechnic train. Motor means enabling the screen to be displaced must therefore be powerful. More often than not it is springs that are used and which remain tensed during the storage phases, which can lead to the deterioration of their mechanical properties and to a reduction in reliability of the armament.

For several years it has been proposed to manufacture all or part of the safety and arming devices using chips incorporating micro-machined or micro-engraved electro-mechanical elements, either in an element deposited on a substrate, or directly on the substrate itself. This technology, known as MEMS (Micro Electra Mechanical System) enables micro-mechanisms to be manufactured implementing a technique similar to that used to produce electronic integrated circuits.

Patent EP2077431 thus discloses a micro-machined safety and arming device in which the arming is fully mechanical and which fulfils the most stringent safety conditions.

Thus, a first lock, or acceleration lock, is released during firing. This lock recoils against the action of a return spring and disengages from a rod integral with the shutter. Once disengaged from the shutter, the first lock is immobilized with respect to the substrate thanks to suitable indentations.

A second lock, or centrifugal lock, is released by the displacement (due to the effect of the projectile's spin) of a counterweight housed in the shutter.

Such a safety and arming device thus enables two independent environmental conditions to be exploited to ensure arming: the longitudinal firing acceleration and the centrifugal acceleration. This double safety enables this device to be compliant with the most stringent standards with respect to projectile arming safety (STANAG 4187).

This safety and arming device nevertheless suffers certain drawbacks.

The first lock in particular (acceleration lock) occupies considerable space in the device. It imposes an increase in the dimensions of the device's substrate and further requires a rod to be provided on the mobile shutter that cooperates with this first lock. In order for the rod not to remain protruding in the pyrotechnic transmission channel in its armed position, it is necessary for the shutter stroke to be extended, thereby further increasing the dimensions of the device.

SUMMARY OF THE INVENTION

The aim of the invention is to propose a micro-machined safety and arming device that does not suffer such a drawback.

The device proposed by the invention incorporates an acceleration lock of simplified structure that ensures the device is compact and reliable.

Thus, the invention relates to a micro-machined or micro-engraved safety and arming device for a projectile pyrotechnic train, device comprising a substrate onto which a shutter is positioned to ensure the blocking of a channel, such shutter being mobile in translation on the substrate, device in which the shutter is held immobile in the safety position by at least one acceleration lock that is released further to the application of the axial acceleration imparted to the projectile during firing, device wherein the acceleration lock is constituted by at least one breakable tongue linking the shutter to the substrate, tongue oriented and dimensioned such that the axial inertial stresses developed during firing and exerted on the shutter cause the said tongue to break.

At least one tongue may be oriented along the axis of the projectile so as to be stressed in traction or in compression.

At least one tongue may be oriented perpendicularly to the projectile axis so as to be shear stressed.

At least one tongue may be linked to the shutter and/or to the substrate by a support of increasing width between the tongue and the shutter and/or the substrate.

BRIEF DESCRIPTION OF THE DRAWINGS

Other advantages will become apparent from the following description of the particular embodiments, such description being made with reference to the appended drawings, in which.

DETAILED DESCRIPTION OF PREFERRED EMBODIMENTS

Figure 1:
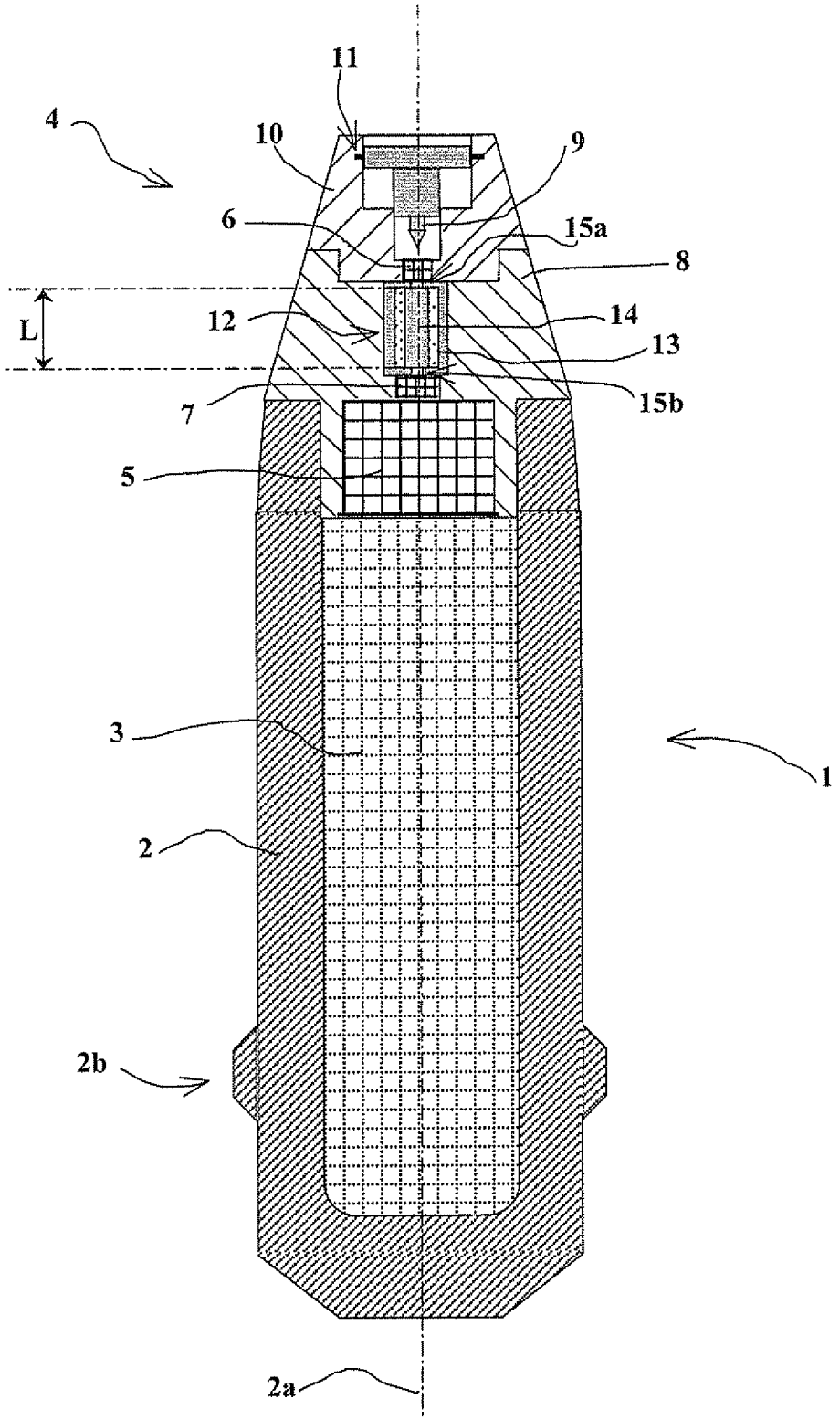
FIG. 1 is a schematic section view of a medium-calibre projectile equipped with a fuse incorporating a safety and arming device according to the invention.

FIG. 1 shows a medium-calibre projectile 1 (calibre of less than 50 mm), comprising a body 2 with axis 2*a* enclosing an explosive load 3. The body 2 receives a fuse 4 at its front part screwed into a threaded hole in the body 2. The fuse 4 comprises a case 8 that encloses a priming charge 5. The priming charge 5 is intended to be ignited by a pyrotechnic train comprising a detonator 6 and relay 7 (alternatively, this relay 7 might be omitted and the detonator 6 will in this case ignite the priming charge 5 directly). The detonator 6 here is a percussion detonator ignited by a firing pin 9 mounted sliding in a nose 10 integral with the case 8 of the fuse 4. When the projectile 1 hits a target, the firing pin 9 is projected onto the detonator 6. The firing pin is held in position during the storage and firing phases by a shearable ring 11.

It is naturally possible for the device according to the invention to be implemented with an electrical detonator 6 controlled, for example, by electronic timing means or by a proximity detector.

The fuse 4 also encloses a safety and arming device 12 that enables the pyrotechnic train to be interrupted during the storage phase and at the onset of the projectile 1 firing phase.

In accordance with the invention, this safety and arming device is made in the form of a micro-machined or micro-engraved device (MEMS). It thus comprises a substrate 13 on which a shutter 14 is mounted sliding to ensure the interruption of the pyrotechnic train.

The substrate 13 incorporates two openings 15*a* and 15*b* arranged on either side of the shutter 14. The axis of these openings 15*a*, 15*b*, and thus the direction of action of the pyrotechnic train (6-7), is thus substantially parallel to the plane of the shutter 14. This axis is also the same as that of the axis 2*a* of the projectile.

Such an arrangement of a shutter to interrupt a pyrotechnic train such that the direction of the pyrotechnic train faces the thickness of the shutter 14 and is not perpendicular to the plane of the shutter (as in conventional MEMS devices) is known namely by patent EP1780496.

Reference can be made by a person skilled in the art to this patent which describes the general characteristics of such a priming train and the shutter associated with it.

It can be noted that the detonator 6 must be of the minimal size still enabling it to function and that it will be coupled with a suitable pyrotechnic relay 7 (or 5). It has been verified that by implementing a detonator incorporating an output stage of 10 milligrams of cyclonite coupled with a highly insensitive relay, for example of HNS (hexanitrostilbene), it was possible to make openings 15*a*, 15*b* (or transmission channels) with a section of less than 1 $mm^2$ (channel diameter of around one mm) whilst ensuring the required ignition transmission.

It is thus possible for the pyrotechnic effect to be interrupted using a silicon shutter with a length L or around 3 mm which can be easily produced using MEMS technology. This length of silicon of around 3 mm corresponds here to the dimension L of the shutter 14 referenced in FIGS. 1 and 2.

The projectile 1 is further equipped with a band 2*b* that slides in the rifling of the gun barrel (not shown) and imparts a spin motion to the projectile 1 around its axis 2*a* during firing.

Figure 2:
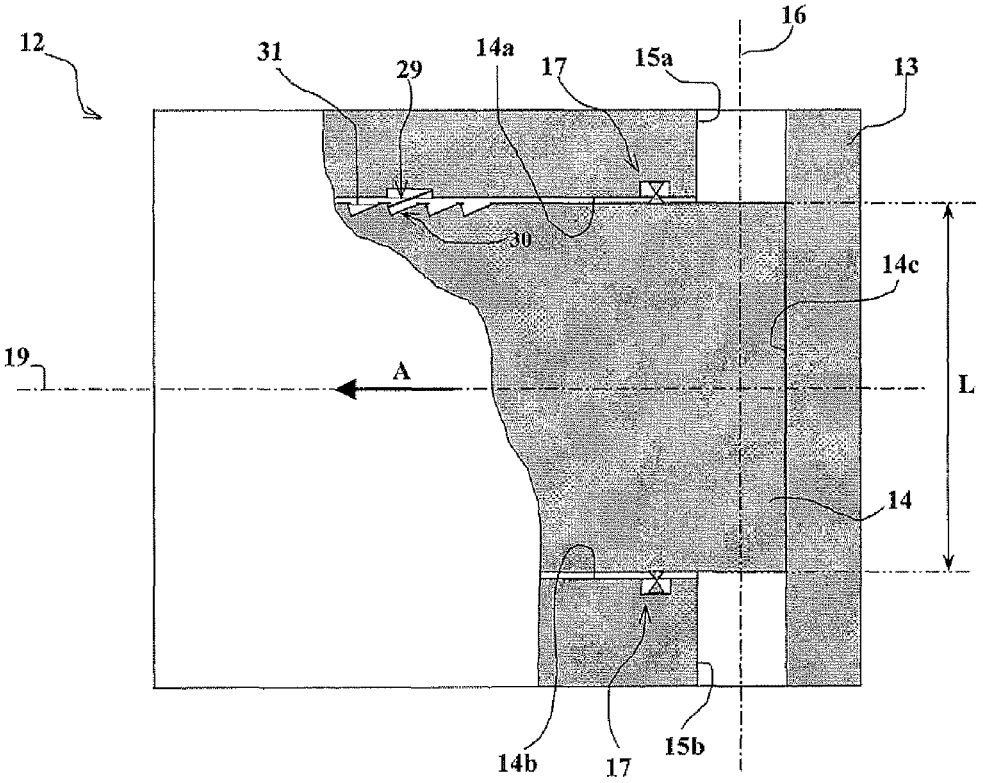
FIG. 2 is a simplified view of an embodiment of the safety and arming device according to the invention in its safety position.

FIG. 2 more simply shows the internal structure of a first embodiment of the safety and arming device 12 according to the invention.

The device comprises a substrate 13 on which a shutter 14 to interrupt the pyrotechnic train is positioned, such shutter being mobile in translation on the substrate in a cavity 31. An arrow A is shown in FIG. 2 which indicates the direction of displacement of the shutter 14 during arming. This direction is perpendicular to the projectile's axis 2*a* (which is the same as axis 16 of openings 15*a* and 15*b*).

The shutter 14 is made by micro-machining or micro-engraving using MEMS techniques well known to one skilled in the art.

FIG. 2 shows the openings 15*a* and 15*b* arranged on either side of the shutter 14 as well as the axis 16 of these openings (thus the direction of action of the pyrotechnic train). The dimension L of the shutter 14 ensures the interruption of the pyrotechnic train in the device's 12 safety position.

The shutter 14 to interrupt the train is held immobile by at least one acceleration lock 17.

The device will also preferably incorporate another lock for the shutter which will be released thanks to the centrifugal force. This type of lock does not form the subject of the present invention. To simplify the description it is not represented. The solution described in patent EP2077431 and quoted in the preamble to the present application may be considered, for example.

It is to be noted also that the tongues 29 integral with the substrate 13 engage in notches 30 arranged on a lateral surface of the shutter 14. These tongues do not prevent the displacement of the shutter in the arming direction A. Both tongues and notches constitute means to prevent the shutter from returning to its safety position after its arming movement.

Figure 3A:
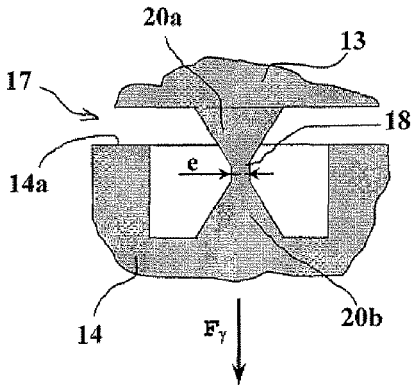
FIGS. 3*a* and 3*b* are enlarged views of two embodiments of a tongue of an acceleration lock.

Here, the device comprises an axial acceleration lock 17 constituted by two breakable tongues 18 that link the shutter 14 to the substrate 13. Each tongue is integral with a lateral edge 14*a* or 14*b* of the shutter 14. FIG. 3*a* shows an enlarged view of one embodiment of such a tongue 18.

The tongues 18 suspending the shutter are oriented in parallel to the projectile's axis, thus such that the axial inertial stresses Fγ, parallel to the axis 2*a* of the projectile, and which are exerted on the shutter 14 during firing will cause the tongues to break. FIG. 3*a* shows an arrow Fγ to indicate the orientation of these inertial stresses.

Furthermore, the tongues 18 will be dimensioned such that this break only occurs as a result of the inertial stresses caused by firing and not those received during shocks to the device or during handling phases or during logistic operations.

The width e of the tongue 18 will thus be calibrated to break during an acceleration of around 50,000 $m/s^2$, which is of the magnitude of accelerations to which medium-calibre projectiles (calibre of less than or equal to 40 mm) are subjected.

It can be observed in FIG. 3 that the tongue 18 is linked to the shutter 14 firstly and to the substrate 13 secondly by supports 20*a* and 20*b* whose width increases between the tongue 18 and the shutter 14 on the one hand and the substrate 13 on the other. These supports 20*a*, 20*b* here are triangular. Such an arrangement enables the location of the break on the tongue 18 to be better controlled. By giving different dimensions to the widened supports 20*a*, 20*b* the break zone constituted by the tongue 18 may, in particular, be brought closer to the shutter or to the substrate.

Depending on the architecture of the device 12 the axial acceleration lock 17 may be made in the form of tongues stressed in traction, in compression or else shear stressed tongues, or a combination of several types of tongue.

Figure 3B:
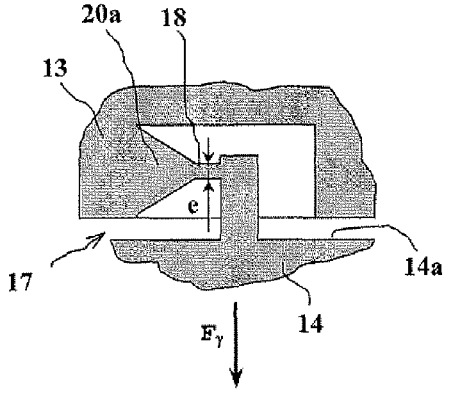

By way of example, FIG. 3*b* shows one embodiment of the device in which the tongue 18 is oriented perpendicularly to the projectile's axis (thus perpendicularly to the direction of Fγ) so as to be shear stressed.

The fact of making the first lock in the form of breakable tongues enables the device to be made more compact. It is no longer necessary for a specific locking mechanism to be made associating locks and return springs. The simplification of the mechanism also makes the device more reliable.

This solution is particularly well adapted in the domain of medium-calibre projectile for which the operational reversibility of the device (return to the safety position) is not an issue.

FIG. 2 shows tongues of the acceleration lock arranged between the shutter 14 and substrate 13 along longitudinal edges 14*a* and 14*b* which are parallel to the arming direction A of the shutter 14. In this FIG. 2, one of the tongues (the tongue on the upper edge 14*a*) is thus stressed in traction and the other tongue (that of the lower edge 14*b*) is stressed in compression.

Figure 4A:
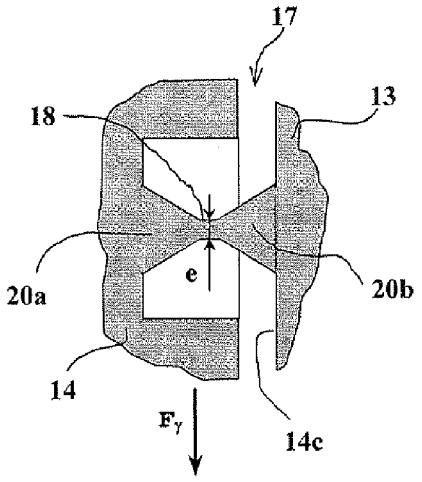
FIGS. 4*a* and 4*b* are enlarged views of two other embodiments of a tongue of an acceleration lock.
Figure 4B:
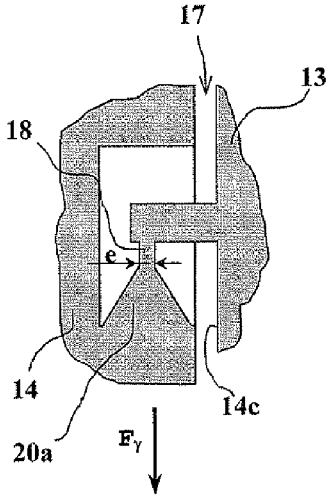

By way of a variant, it is possible for a tongue of the lock 17 according to the invention to be arranged on the lateral edge 14*c*. This lock may comprise a tongue 18 working in shear as shown in FIG. 4*a* or else a tongue working in traction as seen in FIG. 4*b*.

In certain cases, and depending on integration constraints, it might be possible for simple tongues to be made in the form of rectangular strips.

Figure 5A:
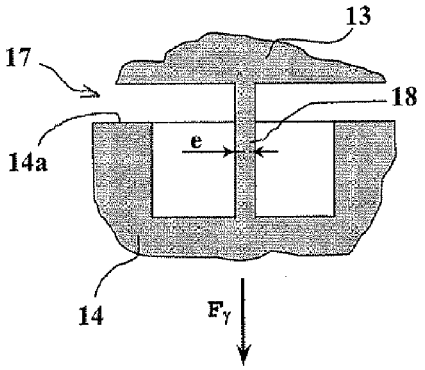
FIGS. 5*a* and 5*b* are enlarged views of two other embodiments of an acceleration lock.
Figure 5B:
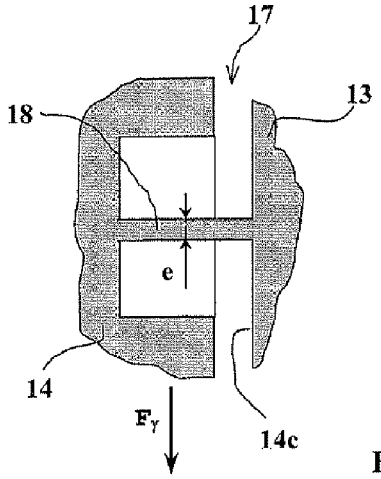

FIGS. 5*a* and 5*b* show such embodiments of the tongues 18 in the form of strips. FIG. 5*a* shows one strip 18 oriented with respect to the inertial stresses Fγ so as to be fractured by traction. FIG. 5*b* shows a strip 18 oriented with respect to the inertial stresses Fγ so as to be fractured by shear.

The acceleration lock according to the invention has been described here by way of example without limitation in its application to a safety and arming device in which the direction of action of the pyrotechnic train is substantially parallel to the plane of the shutter.

It is obvious that for a person skilled in the art it is possible for the invention to be implemented in any other type of safety and arming device with a mobile shutter.

Such an acceleration shutter may be envisaged, for example, for safety and arming devices in which the direction of action of the pyrotechnic train is perpendicular to the shutter. Such devices are disclosed, for example, in EP1601926.

This lock could also be envisaged for devices in which the shutter does not ensure the interruption of the pyrotechnic train but rather the interruption of an optical control signal (for example for the ignition of an explosive using a laser beam). Such devices are known in particular by EP1559986, EP1559987.

A lock according to the invention might also be used for safety and arming devices in which the shutter interrupts a channel through which a foil projected by a detonator (of the "slapper" type) passes, this device is described, for example, by U.S. Pat. No. 6,173,650.

Lastly, the invention may be implemented in safety and arming devices in which the shutter itself carries a pyrotechnic composition to be introduced into an ignition train, devices such as those described in patents U.S. Pat. Nos. 6,622,629, 7,552,681 and 7,490,552.

What is claimed is:

1. A micro-machined or micro-engraved safety and arming device for a projectile pyrotechnic train, said device comprising a substrate onto which a shutter is positioned in a safety position to ensure the blocking of a pyrotechnic transmission channel, said shutter being mobile in translation on said substrate between the safety position and an armed position, said shutter being held immobile in the safety position by at least one acceleration lock that is released further to the application of the axial acceleration imparted to said projectile during firing, wherein said acceleration lock is constituted by at least one breakable tongue linking said shutter to said substrate, said tongue being oriented and dimensioned such that the axial inertial stresses developed during firing and exerted on said shutter cause said tongue to break.

2. A safety and arming device according to claim 1, wherein said at least one tongue is oriented along the axis of said projectile so as to be stressed in traction or in compression.

3. A safety and arming device according to claim 2, wherein said at least one tongue is linked to said shutter and/or to said substrate by a support of increasing width between said at least one tongue and said shutter and/or said substrate.

4. A safety and arming device according to claim 1, wherein said at least one tongue is oriented perpendicularly to said projectile axis so as to be shear stressed.

5. A safety and arming device according to claim 4, wherein said at least one tongue is linked to said shutter and/or to said substrate by a support of increasing width between said at least one tongue and said shutter and/or said substrate.

6. A safety and arming device according to claim 1, wherein the shutter is mobile in translation on said substrate in an arming direction perpendicular to an axial direction.

7. A safety and arming device according to claim 6, wherein a plurality of said tongues of said acceleration lock are arranged between the shutter and the substrate along longitudinal edges of the shutter which are parallel to the arming direction of the shutter.

8. A safety and arming device according to claim 1, wherein the substrate comprises two openings arranged on either side of the shutter, and wherein the axis of the two openings corresponds to the direction of action of the pyrotechnic train.

9. A safety and arming device according to claim 8, wherein said axis of said two openings is parallel to the plane of the shutter, and wherein the direction of the pyrotechnic train faces the thickness of the shutter.

10. A safety and arming device according to claim 9, wherein the length of the shutter ensures the interruption of the pyrotechnic train in the safety position.

11. A safety and arming device according to claim 8, wherein the shutter is mobile in translation in a cavity of the substrate.

12. A safety and arming device according to claim 1, wherein the shutter made using MEMS techniques is made of silicon.

* * * * *